US011526186B2

(12) United States Patent
Chang et al.

(10) Patent No.: US 11,526,186 B2
(45) Date of Patent: Dec. 13, 2022

(54) RECONFIGURABLE SERIES-SHUNT LDO

(71) Applicant: MediaTek Inc., Hsin-Chu (TW)

(72) Inventors: Po-Jung Chang, Hsinchu (TW); Yan-Jiun Chen, Hsinchu (TW); Chih-Hong Lou, Hsin-Chu (TW)

(73) Assignee: MediaTek Inc., Hsin-Chu (TW)

( * ) Notice: Subject to any disclaimer, the term of this patent is extended or adjusted under 35 U.S.C. 154(b) by 112 days.

(21) Appl. No.: 17/065,445

(22) Filed: Oct. 7, 2020

(65) Prior Publication Data

US 2021/0216092 A1 Jul. 15, 2021

Related U.S. Application Data

(60) Provisional application No. 62/958,770, filed on Jan. 9, 2020.

(51) Int. Cl.
*G05F 1/575* (2006.01)

(52) U.S. Cl.
CPC ..... *G05F 1/575* (2013.01)

(58) Field of Classification Search
CPC ..... G05F 1/462; G05F 1/465; G05F 1/468; G05F 1/56; G05F 1/575; G05F 1/562;
(Continued)

(56) References Cited

U.S. PATENT DOCUMENTS 6,603,292 B1 * 8/2003 Schouten ..... G05F 1/573 323/277
7,253,589 B1 * 8/2007 Potanin ..... H02J 7/00309 320/144

(Continued)

FOREIGN PATENT DOCUMENTS

CN 103809638 A 5/2014
CN 107037850 * 9/2016

(Continued)

OTHER PUBLICATIONS

Partial European Search Report dated Apr. 13, 2021 in connection with European Application No. 20203119.1.

(Continued)

*Primary Examiner* — Thienvu V Tran
*Assistant Examiner* — Nusrat Quddus
(74) *Attorney, Agent, or Firm* — Wolf, Greenfield & Sacks, P.C.

(57) ABSTRACT

A low-dropout regulator (LDO) capable of providing high power-supply rejection ratio (PSRR) and good reverse isolation. The LDO may include a core circuitry and a reverse isolation circuitry. The core circuitry may include a PSRR circuitry coupled to an output node and configured to provide high PSRR at the output node. The reverse isolation circuitry may be configured to provide good reverse isolation at the output node by, for example, providing current in response to ripples at the output node. The reverse isolation circuitry may be configured with bandwidth higher than that of the core circuitry such that it can provide fast transient response. The reverse isolation circuitry may be configurable and/or reconfigurable for a desirable reverse isolation performance. The reverse isolation circuitry may be configurable and/or reconfigurable to trade off between power consumed by the reverse isolation circuitry and a leakage current flowing through the core circuitry.

18 Claims, 9 Drawing Sheets

(58) Field of Classification Search
CPC ..... G05F 1/565; G05F 1/567; G05F 1/569; G05F 1/571; G05F 1/573; G05F 1/5735
See application file for complete search history.

(56) References Cited

U.S. PATENT DOCUMENTS 7,274,114 B1 * 9/2007 Wong ..... G05F 1/56 307/72
7,274,176 B2 * 9/2007 Mihara ..... G05F 1/575 323/269
8,089,822 B1 * 1/2012 Chankya ..... G11C 5/147 365/191
8,169,203 B1 * 5/2012 Vemula ..... G05F 1/575 323/273
8,378,652 B2 * 2/2013 Xie ..... G05F 1/565 323/280
9,436,196 B2 * 9/2016 Chan ..... G05F 1/618
9,454,168 B2 9/2016 Patel et al.
9,740,225 B1 8/2017 Wong
9,893,607 B1 * 2/2018 Wan ..... H02M 3/07
2005/0206437 A1 * 9/2005 Baldwin ..... G05F 1/56 327/427
2005/0242796 A1 * 11/2005 Yang ..... G05F 1/575 323/282
2006/0255779 A1 11/2006 Huang et al.
2007/0108949 A1 * 5/2007 Ohoka ..... G05F 1/573 323/271
2009/0015219 A1 * 1/2009 Taha ..... G05F 1/565 323/271
2009/0066403 A1 * 3/2009 Horsky ..... G05F 1/571 327/398
2009/0219004 A1 * 9/2009 Hirano ..... H02M 3/158 323/293
2010/0156362 A1 * 6/2010 Xie ..... G05F 1/565 323/273
2011/0115556 A1 * 5/2011 May ..... G05F 1/618 327/540
2011/0193538 A1 * 8/2011 Arigliano ..... G05F 1/563 323/282
2012/0146595 A1 * 6/2012 Wong ..... G05F 1/56 323/265
2012/0176822 A1 * 7/2012 Menegoli ..... H02M 3/156 323/272
2012/0205978 A1 * 8/2012 Wong ..... G05F 1/56 307/31
2013/0307506 A1 * 11/2013 Oh ..... G05F 1/575 323/282
2014/0117958 A1 * 5/2014 Price ..... G05F 1/468 323/281
2014/0266104 A1 * 9/2014 El-Nozahi ..... G05F 1/575 323/280
2014/0320229 A1 * 10/2014 Ali ..... H03H 11/30 333/17.3
2014/0340058 A1 * 11/2014 Wang ..... H02M 1/15 323/268
2015/0008871 A1 * 1/2015 Petenyi ..... G05F 1/569 323/270
2015/0115918 A1 * 4/2015 Oikarinen ..... G05F 1/575 323/280
2015/0171743 A1 * 6/2015 Yeon ..... H02M 3/156 323/282
2015/0177759 A1 * 6/2015 Mallinson ..... G05F 1/575 323/281
2015/0207406 A1 7/2015 Potanin et al.
2016/0048148 A1 * 2/2016 Lee ..... G05F 1/575 323/280
2016/0056798 A1 * 2/2016 Chan ..... G05F 1/618 327/108
2016/0134135 A1 * 5/2016 Liu ..... H02J 7/007182 320/107
2016/0204702 A1 * 7/2016 Padyana ..... H02M 3/1563 323/271
2017/0090495 A1 3/2017 Ramos et al.
2017/0115678 A1 * 4/2017 Qing ..... G05F 1/575
2017/0126329 A1 * 5/2017 Gorecki ..... G05F 1/575
2017/0199537 A1 * 7/2017 Duong ..... G05F 1/575
2017/0364111 A1 * 12/2017 Flaibani ..... G05F 1/575
2018/0041121 A1 * 2/2018 Sneep ..... H02M 1/08
2018/0292853 A1 * 10/2018 Jefremow ..... G05F 1/565
2019/0190252 A1 * 6/2019 Hanagami ..... H03K 17/08122
2019/0235543 A1 * 8/2019 Chen ..... G05F 1/575
2019/0258282 A1 * 8/2019 Magod Ramakrishna ..... G05F 1/575
2019/0302819 A1 * 10/2019 Hu ..... G05F 1/575
2019/0302820 A1 * 10/2019 Yasu ..... G05F 1/575
2019/0317536 A1 * 10/2019 Liu ..... G05F 1/595
2019/0384338 A1 * 12/2019 Vogt ..... G05F 1/565
2020/0064875 A1 * 2/2020 Gonapati ..... G05F 1/573
2020/0225689 A1 * 7/2020 Vannorsdel ..... G05F 1/565
2021/0072778 A1 * 3/2021 Chao ..... G05F 1/618
2022/0137656 A1 * 5/2022 Vangara ..... G05F 1/565 323/280
2022/0140791 A1 * 5/2022 Vangara ..... G05F 1/575 330/90

FOREIGN PATENT DOCUMENTS

CN 113970947 * 7/2020
CN 112558677 * 12/2020
CN 113110694 * 4/2021
EP 1 378 808 A1 1/2004
KR 2012-0098025 A 9/2012
TW 200743291 A 11/2007
TW 201528667 A 7/2015

OTHER PUBLICATIONS

Extended European Search Report dated Jul. 26, 2021 in connection with European Application No. 20203119.1.

* cited by examiner

RECONFIGURABLE SERIES-SHUNT LDO

RELATED APPLICATIONS

This application claims priority to and the benefit of U.S. Provisional Application Ser. No. 62/958,770, filed Jan. 9, 2020 and titled "RECONFIGURABLE SERIES-SHUNT LDO," which is hereby incorporated herein by reference in its entirety.

TECHNICAL FIELD

This application relates generally to low-dropout regulators (LDOs).

BACKGROUND

A regulator converts an unstable power supply voltage into a stable power supply voltage. A low dropout regulator (LDO) has a low input-to-output voltage difference between an input terminal where an unstable power supply voltage is inputted and an output terminal where a stable power supply voltage is outputted. "Dropout voltage" refers to the input-to-output voltage difference, whereby the regulator ceases to regulate against further reductions in input voltage. Ideally, the dropout voltage should be as low as possible, to allow the input voltage to be relatively low, while still maintaining regulation.

SUMMARY

Low-dropout regulators (LDOs) with high power-supply rejection ratio (PSRR) and good reverse isolation are provided.

Some embodiments relate to a low-dropout regulator comprising a core circuitry providing an output voltage to an output node; and a reverse isolation circuitry coupled to the output node and configured to provide a current flowing through the reverse isolation circuitry in response to ripples at the output node.

In some embodiments, the reverse isolation circuitry is configured with bandwidth higher than that of the core circuitry such that the reverse isolation circuitry responds to the ripples at the output node faster than the core circuitry.

In some embodiments, the reverse isolation circuitry is configured such that a current flowing through the core circuitry is constant regardless the ripples at the output node or an alternating current (AC) component of the current flowing through the core circuitry is smaller than an AC component required to respond to the ripples at the output node.

In some embodiments, the reverse isolation circuitry adjusts the current flowing through the reverse isolation circuitry based on the magnitude of the ripples at the output node.

In some embodiments, the reverse isolation circuitry comprises a transistor coupled to the output node and having a gate node controlled by a gate voltage generated based at least in part on the output voltage at the output node.

In some embodiments, the transistor of the reverse isolation circuitry is a plurality of transistors connected in parallel.

In some embodiments, the core circuitry comprises a transistor coupled to the output node and having a gate node controlled by a gate voltage generated based at least in part on the output voltage at the output node.

In some embodiments, the transistor of the core circuitry is a pass transistor receiving a power supply voltage to generate the output voltage at the output node.

In some embodiments, the core circuitry comprises a direct current (DC) circuitry coupled to the output node and comprising a power transistor configured to provide the output voltage at the output node, and a power-supply rejection ratio (PSRR) circuitry coupled to the output node and configured to provide a high PSRR.

In some embodiments, the PSRR circuitry comprises an operational amplifier configured to provide a gate voltage based at least in part on the output voltage at the output node, and a capacitor coupled to the gate voltage.

Some embodiments relate to a low-dropout regulator comprising a core circuitry providing an output voltage to an output node; and a reverse isolation circuitry coupled to the output node and configured to adjust a current flowing through the reverse isolation circuitry in response to ripples at the output node.

In some embodiments, the current flowing through the reverse isolation circuitry is adjusted at least in part to trade off between power consumed by the reverse isolation circuitry and a leakage current flowing through the core circuitry.

In some embodiments, the reverse isolation circuitry comprises a plurality of transistors connected in parallel, and one or more of the plurality of transistors are turned on depending on a tradeoff between power consumed by the reverse isolation circuitry and a leakage current flowing through the core circuitry.

In some embodiments, the reverse isolation circuitry comprises a transistor coupled to the output node and having a gate node controlled by a gate voltage generated based at least in part on the output voltage at the output node.

In some embodiments, the core circuitry comprises a transistor coupled to the output node and having a gate node controlled by a gate voltage generated based at least in part on the output voltage at the output node.

In some embodiments, the transistor of the core circuitry is a pass transistor receiving a power supply voltage to generate the output voltage at the output node.

In some embodiments, the core circuitry comprises a direct current (DC) circuitry coupled to the output node and comprising a power transistor configured to provide the output voltage at the output node, and a power-supply rejection ratio (PSRR) circuitry coupled to the output node and configured to provide a high PSRR.

In some embodiments, the PSRR circuitry comprises an operational amplifier configured to provide a gate voltage based at least in part on the output voltage at the output node, and a capacitor coupled to the gate voltage.

In some embodiments, the core circuitry comprises a decrease gain circuitry coupled to the output node and configured to reduce a gain of the DC circuitry.

Some embodiments relate to a low-dropout regulator comprising a core circuitry configured to provide an output voltage to an output node; and a reverse isolation circuitry coupled to the output node and configured to provide a current flowing through the reverse isolation circuitry. The current flowing through the reverse isolation circuitry is configurable and/or reconfigurable.

These techniques may be used alone or in any suitable combination. The foregoing summary is provided by way of illustration and is not intended to be limiting.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Described herein are low-dropout regulators (LDOs) with high power-supply rejection ratio (PSRR) and good reverse isolation. The inventors have recognized and appreciated that conventional LDOs are designed to trade off between PSRR performance and reverse isolation performance. One type of conventional LDO may sacrifice reverse isolation performance for high PSRR. Alternatively, another type of conventional LDO may trade off PSRR performance for good reverse isolation. Further, a conventional LDO with good reverse isolation may consume more power than a conventional LDO with high PSRR.

The inventors have developed LDOs that can have high PSRR (e.g., at least 30 dB in 2 MHz bandwidth) and good reverse isolation (e.g., at least 10 dB) at the same time. In some embodiments, the LDOs may be configurable and/or reconfigurable for a desirable reverse isolation performance. In some embodiments, the reverse isolation circuitry may be configurable and/or reconfigurable to trade off between power consumed by the reverse isolation circuitry and a leakage current flowing through the core circuitry.

Figure 1:
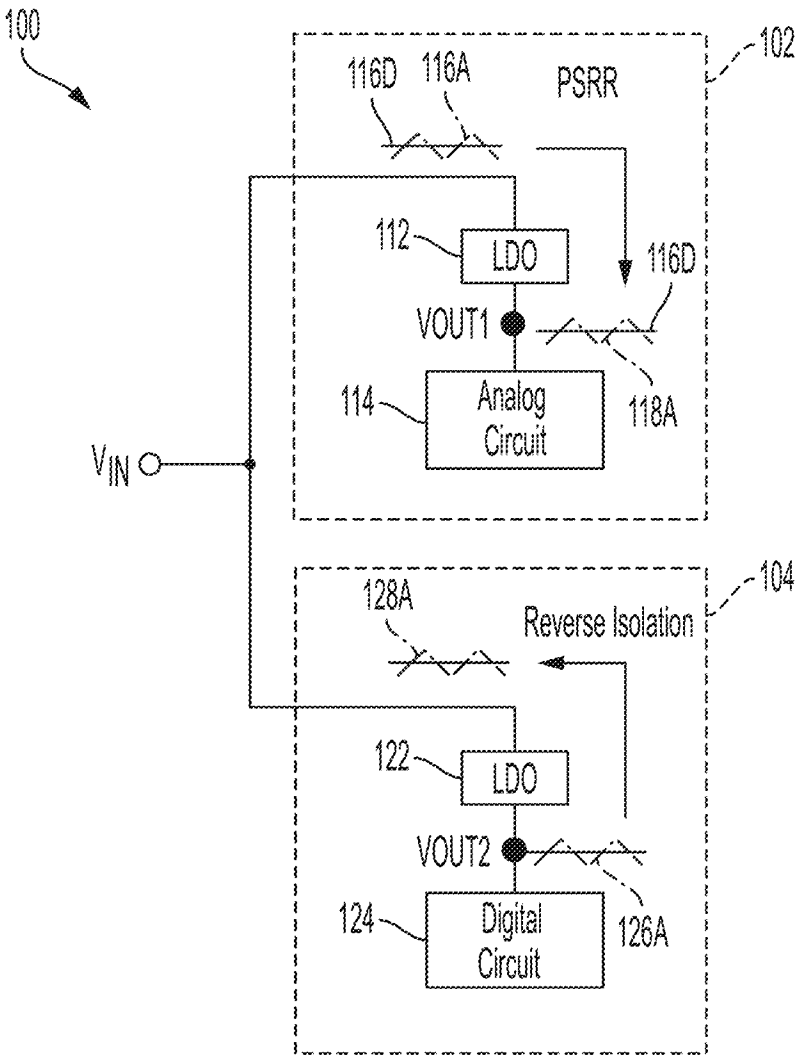
FIG. 1 is a block diagram of a system with low dropout regulators (LDOs), according to some embodiments.

A system may include one or more low dropout regulators (LDOs) configured to provide stable power supply voltages to respective loading circuits. FIG. 1 depicts a system 100 with multiple LDOs, according to some embodiments. The system 100 may receive a power supply $V_{IN}$ from one or more power supplies including, for example, one or more batteries. The system 100 may include one or more LDOs, each of which may receive an input power supply $V_{IN}$ and provide an output power supply $V_{OUT}$ to a respective loading circuit. While the voltage difference between the input power supply $V_{IN}$ and output power supply voltage $V_{OUT}$ may be low, the output power supply $V_{OUT}$ may be a more stable voltage compared to the input power supply $V_{IN}$. The example illustrated in FIG. 1 shows two LDOs 112 and 114 providing power supplies $V_{OUT1}$ and $V_{OUT2}$ to an analog circuit 114 and a digital circuit 124, respectively.

The system 100 may include one or more analog circuit LDO branches 102 and one or more digital circuit LDO branches 104. Although the illustrated example shows that the LDO branches 102 and 104 share the power supply $V_{IN}$, it should be appreciated that an LDO branch may access a separate input power supply.

An analog circuit LDO branch 102 may include the LDO 112 providing power to the analog circuit 114. Examples of the analog circuit 114 may include a CMOS image sensor and/or a gimbal, which are provided for illustration purposes and should not limit the scope of an analog circuit. Similarly, a digital circuit LDO branch 104 may include the LDO 122 providing power to the digital circuit 124. Examples of the digital circuit 124 may include an electronic speed controller and/or a processor, which are provided for illustration purposes and should not limit the scope of a digital circuit. Although the illustrated example shows analog circuit 114 and digital circuit 124, it should be appreciated that an LDO may provide power to a mixed-signal circuit.

In some embodiments, the power supply $V_{IN}$ may ideally be a direct current (DC) power supply. However, in reality, the power supply $V_{IN}$ may include a DC component overlaid with ripples, which may be one of the reasons that the power supply $V_{IN}$ is less stable and/or noisy. The ripples may be a composite waveform including harmonics of a fundamental frequency, which may be the line frequency of the original alternating current (AC) source that is used to produce the power supply $V_{IN}$. The ripples may be due to incomplete suppression of the alternating waveform after rectification of the AC source. The magnitudes of the ripples may depend on the harmonics the ripples may be associated with. The ripples may be caused by circuits including, for example, switched-mode power supplies, capacitor input rectifiers, and active rectifiers.

In some embodiments, an LDO may be configured to attenuate ripples from a power supply and provide a less noisy power to a loading circuit. In the example illustrated in FIG. 1, the LDO 112 may receive from the power supply $V_{IN}$ a DC component 116D overlaid with an AC component 116A. The LDO 112 may be configured to provide the DC component 116D to the analog circuit 114. The LDO 112 may be configured to reduce the AC component 116A such that the analog circuit 114 receives an AC component 118A that has a magnitude smaller than the AC component 116A. The PSRR of the LDO 112 may specify a ratio between the AC power element 116A at the input of the LDO 112 and the AC power element 118A at the output of the LDO 112. The higher PSRR the LDO 112 has, the lower noise the analog circuit 114 would be subject to.

In some embodiments, an LDO may be configured to reduce crosstalk caused by ripples and provide good reverse isolation. In the example illustrated in FIG. 1, the analog circuit 124 may be affected by ripples caused by another circuit such as the digital circuit LDO branch 102 through a common ground and/or a common power supply. The digital circuit 124 may pass the ripples to the output of the LDO 122 as an AC component 126A. The LDO 122 may pass the AC component 126A to its input as an AC component 128A, which may be passed to and affect the analog circuit 114. Reverse isolation may mitigate the current a common ground and/or a common power supply caused by digital circuit and/or mixed-signal circuit's operation. The better reverse isolation an LDO has, the lower noise of digital circuit and/or mixed-signal circuit may inject to a common ground and/or a common power supply. It should be appreciated that the illustration of the AC components herein are simplified and not drawn to scale, and provided only for illustration purpose.

Figure 2:
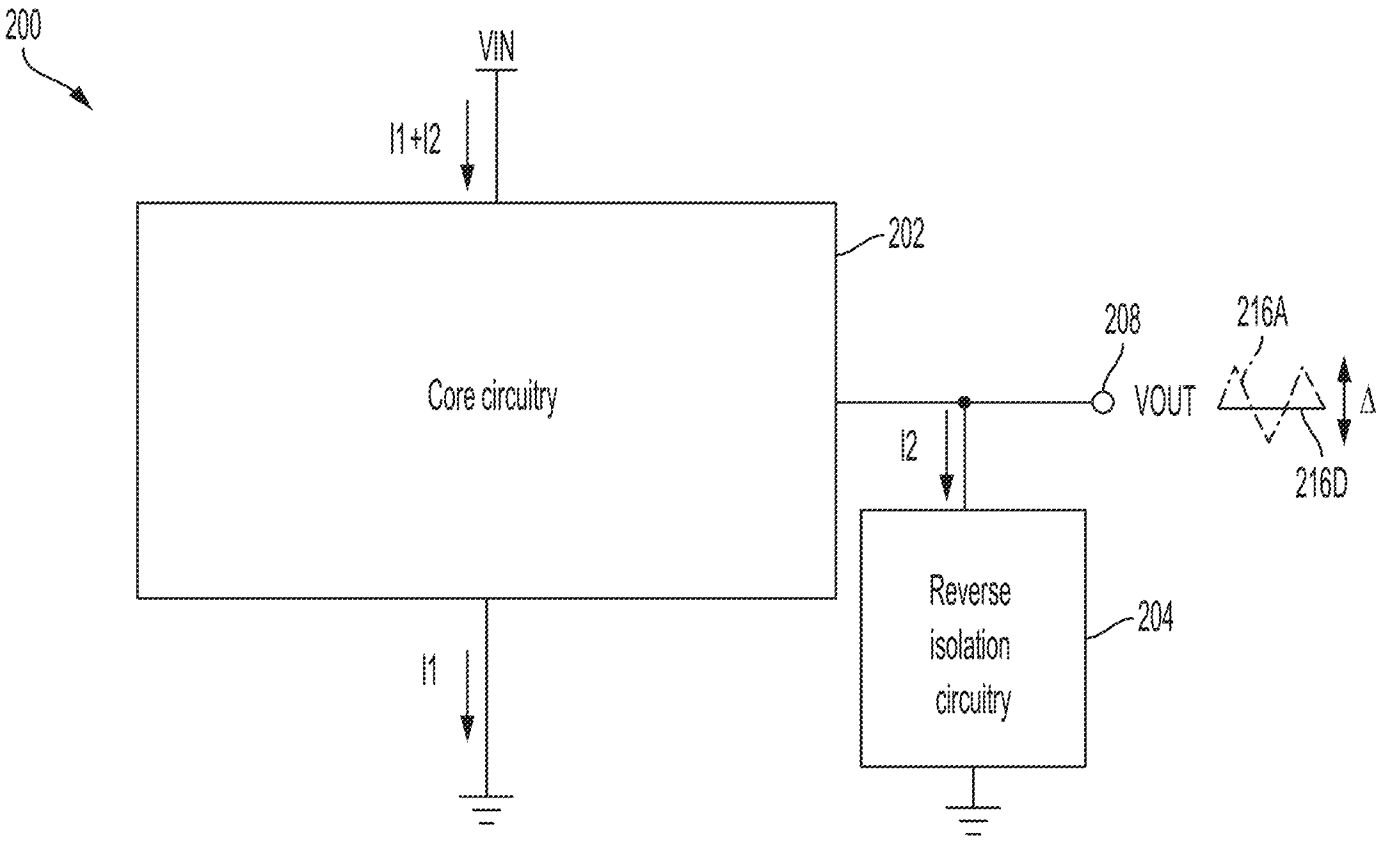
FIG. 2 is a block diagram of a low dropout regulator, according to some embodiments.

LDOs may be configured to have high PSRR and good reverse isolation, according to some embodiments. FIG. 2 illustrates a block diagram of such an LDO 200, which may convert an input power supply $V_{in}$ to an output power supply $V_{OUT}$ at an output node 208. The output power supply $V_{OUT}$ may be provided to a loading circuit (not shown). The output power supply $V_{OUT}$ may include a DC component 216D overlaid with an AC component 216A that may have a magnitude Δ. The AC component 216A may correspond to ripples at least in part caused by adjacent circuits through a common ground and/or a common power supply.

The LDO 200 may include a core circuitry 202 having a current I1 flowing therethrough, and a reverse isolation circuitry 204 having a current I2 flowing therethrough. In some embodiments, the core circuitry 202 may be configured to provide the output power supply $V_{OUT}$ at the output node 208. In some embodiments, the core circuitry 202 may be configured to operate with a bandwidth lower than that of the reverse isolation circuitry 204 such that the core circuitry 202 provides DC and low frequency functions. In some embodiments, the core circuitry 202 may be configured to attenuate ripples from the power supply $V_{in}$ such that the LDO 200 has high PSRR.

The reverse isolation circuitry 204 may be configured to respond to the ripples at the output node 208. In some embodiments, the reverse isolation circuitry 204 may be configured to operate with high bandwidth (e.g., in the range of 40 MHz to 160 MHz) such that the reverse isolation circuitry 204 may respond to the ripples at the output node 208 faster than the core circuitry 202. In some embodiments, the reverse isolation circuitry 204 may be configured to sense a transient waveform of the output power supply $V_{OUT}$ at the output node 208 and adjust the current I2 flowing therethrough in response to the AC component 216A of the output power supply $V_{OUT}$ such that the current I1 flowing through the core circuitry 202 is constant regardless the ripples at the output node 208.

In some embodiments, the reverse isolation circuitry 204 may be configurable and/or reconfigurable to trade off between power consumed by the reverse isolation circuitry 204 and a leakage current flowing through the core circuitry 202. For example, under a first operation condition that may correspond to a first input power supply and/or a first loading circuit coupled to the LDO 200, the reverse isolation circuitry 204 may be configured such that the LDO 200 has a reverse isolation performance of 10 dB. Under a second operation condition that may correspond to a second input power supply and/or a second loading circuit coupled to the LDO 200, the reverse isolation circuitry 204 may be reconfigured such that the LDO 200 has a reverse isolation performance of 20 dB. Under a third operation condition that may correspond to a third input power supply and/or a third loading circuit coupled to the LDO 200, the reverse isolation circuitry 204 may be reconfigured such that the LDO 200 has a reverse isolation performance of 15 dB.

In some embodiments, the reverse isolation circuitry 204 may be configurable and/or reconfigurable to adjust the current I2 flowing therethrough in response to the AC component 216A at the output node 208 to trade off between power consumed by the reverse isolation circuitry 204 and a leakage current flowing through the core circuitry 202. For example, the current I2 flowing through the core circuitry may be configured to be smaller than an AC component required to fully compensate the ripples at the output node 208. The current I1 flowing through the core circuitry 202 may include a leakage current such as an AC component generated by the core circuitry 202 in response to the ripples at the output node 208 that are not compensated by the current I2.

Figure 3:
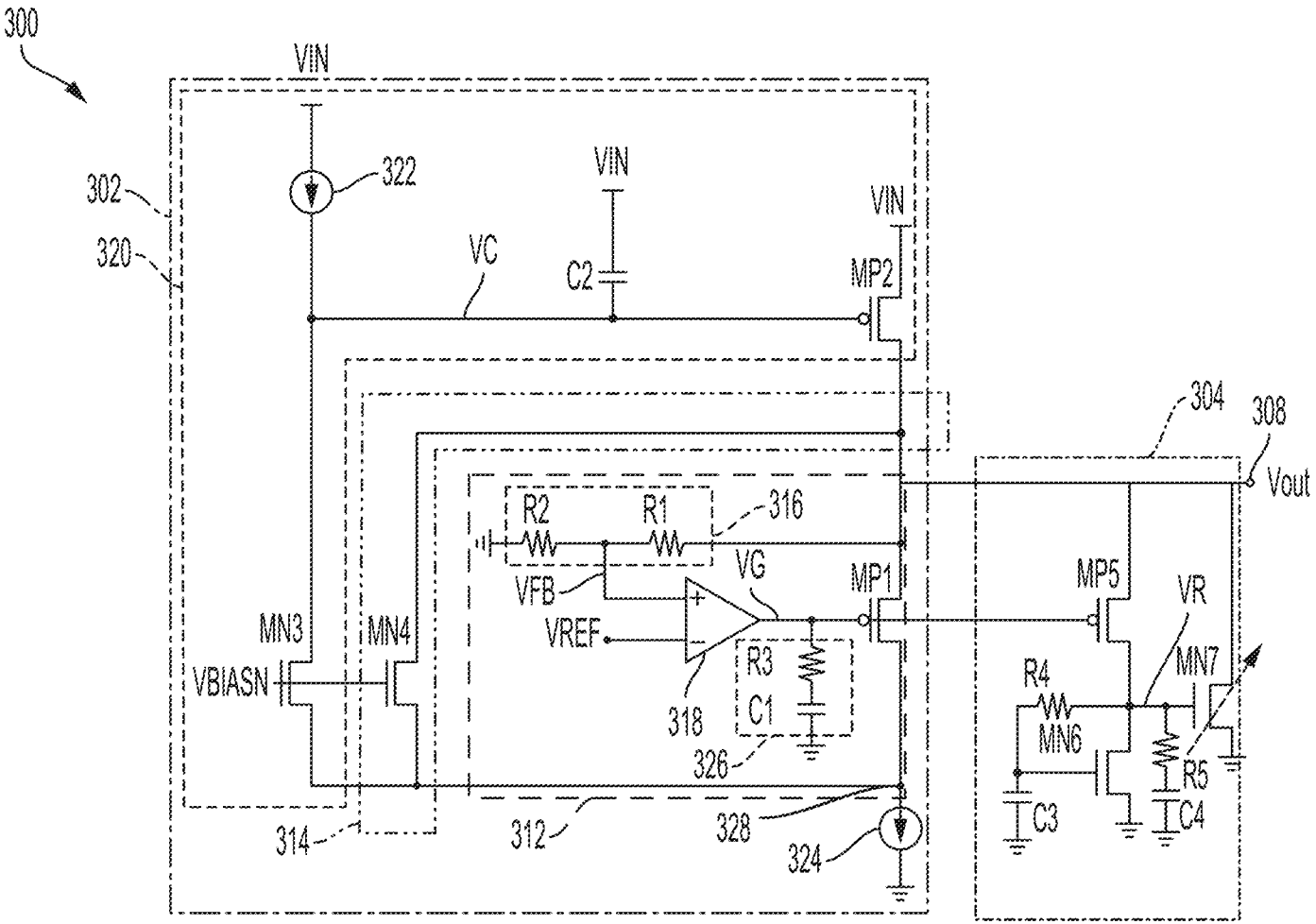
FIG. 3 is a schematic diagram of an LDO, according to some embodiments.

The LDO 200 with high PSRR and good reverse isolation may be implemented in various configurations. FIG. 3 depicts a schematic diagram of an LDO 300, according to some embodiments. The LDO 300 may include a core circuitry 302 configured to provide an output voltage $V_{OUT}$ at an output node 308, and a reverse isolation circuitry 304 coupled to the output node 308.

The core circuitry 302 may include a PSRR circuitry 312, a DC circuitry 320, and a decrease gain circuitry 314. The PSRR circuitry 312 may be configured to provide high PSRR. The PSRR circuitry 312 may include a p-type pass transistor MP1, a feedback circuitry 316, an operational amplifier 318, and a compensation circuitry 326. The p-type pass transistor MP1 may be coupled between the output node 308 and a current source 324. The drain-to-source resistance of the p-type pass transistor MP1 may be controlled by a gate voltage $V_G$ such that a stable output voltage $V_{OUT}$ is generated at the output node 308.

The feedback circuitry 316 may include two resistors R1 and R2 connected in series between the output node 308 and a ground. It should be appreciated that a ground need not be connected to earth ground, but may carry reference potentials, which may include earth ground, DC voltages or other suitable reference potentials. The feedback circuitry 316 may generate a feedback voltage $V_{FB}$, which may be a divided voltage of the output voltage $V_{OUT}$ by the resistors R1 and R2. The operational amplifier 318 may compare the feedback voltage $V_{FB}$ with a reference voltage $V_{REF}$, and generate the gate voltage $V_G$ that may vary depending upon the voltage difference between the reference voltage $V_{REF}$ and the feedback voltage $V_{FB}$.

The compensation circuitry 326 may be coupled to the gate of the p-type pass transistor MP1 to provide desired filtering to the gate voltage $V_G$ and enhance the stability of the output voltage $V_{OUT}$. The compensation circuitry 326 may include a capacitor C1 and a resistor R3 connected in series between the gate of the p-type pass transistor MP1 and a ground.

The DC circuitry 320 may be configured to provide a stable output voltage at the output node 308. The DC circuitry 320 may be coupled to the output node 308. The DC circuitry 320 may include a p-type power transistor MP2 between a power supply $V_{IN}$ and the output node 308. The p-type power transistor MP2 may be configured to provide the output voltage $V_{OUT}$ at the output node 308. The DC circuitry 320 may include a current source 322 and an n-type transistor MN3 connected in series with the current source 322. The n-type transistor MN3 may be coupled between the output node 308 and the current source 324. A control voltage $V_C$ at the gate of the p-type power transistor MP2 may be determined by the current source 322 and a gate-to-source voltage of the p-type power transistor MP2. The gate of the transistor MN3 may receive a biasing voltage $V_{BIASN}$, which may determine a voltage at node 328 that prevents the p-type pass transistor MP1 and current source 324 from entering triode region. A capacitor C2 may be coupled between the power supply $V_{IN}$ and the gate of the p-type power transistor MP2 and configured to enhance the stability of the output voltage $V_{OUT}$. In some embodiments, the capacitor C2 may have a capacitance in the range of 0.1 pF to 5 pF, in the range of 1 PF to 2 PF, or any suitable number in between, which may be significantly smaller than that of capacitors in conventional LDOs.

The decrease gain circuitry 314 may be configured to reduce a gain of the DC circuitry 320. The decrease gain circuitry 314 may be coupled to the output node 308. The decrease gain circuitry 314 may include an n-type transistor MN4 coupled between the output node 308 and the current source 324. The gate of the n-type transistor MN4 may receive the biasing voltage $V_{BIASN}$.

The reverse isolation circuitry 304 may be configured to provide a current flowing therethrough in response to ripples at the output node 308. The reverse isolation circuitry 304 may include a p-type transistor MP5 and an n-type transistor MN6 connected in series and coupled between the output node 308 and the ground. The p-type transistor MP5 may receive the gate voltage $V_G$ generated by the operational amplifier 318. The reverse isolation circuitry 304 may include a capacitor C3 and a resistor R4 connected in series and coupled between the drain of the n-type transistor MN6 and the ground. The capacitor C3 and resistor R4 may be configured to enhance the gain of the reverse isolation circuitry 304. The gate of the n-type transistor MN6 may be coupled to a node dividing the capacitor C3 and a resistor R4. The transistors MP5 and MN6 may generate a reverse isolation control voltage $V_R$ based at least in part on the gate voltage $V_G$ generated by the operational amplifier 318.

The reverse isolation circuitry 304 may include a reconfigurable n-type transistor MN7 coupled between the output node 308 and the ground. The gate of the reconfigurable n-type transistor MN7 may receive the reverse isolation control voltage $V_R$. The reconfigurable transistor MN7 may be adjusted based at least in part on the reverse isolation control voltage $V_R$ to trade off between power consumed by the reverse isolation circuitry 304 and a leakage current flowing through the core circuitry 302. In some embodiments, the reconfigurable n-type transistor MN7 may include a plurality of n-type transistors connected in parallel. The number of n-type transistors being turned on may be configured based at least in part on the reverse isolation control voltage $V_R$ to trade off between power consumed by the reverse isolation circuitry 304 and a leakage current flowing through the core circuitry 302.

The reverse isolation circuitry 304 may include a capacitor C4 and a resistor R5 connected in series and coupled between the gate of the reconfigurable n-type transistor MN7 and the ground. The capacitor C4 and resistor R5 may be configured to enhance the stability of the output voltage $V_{OUT}$.

Figure 4:
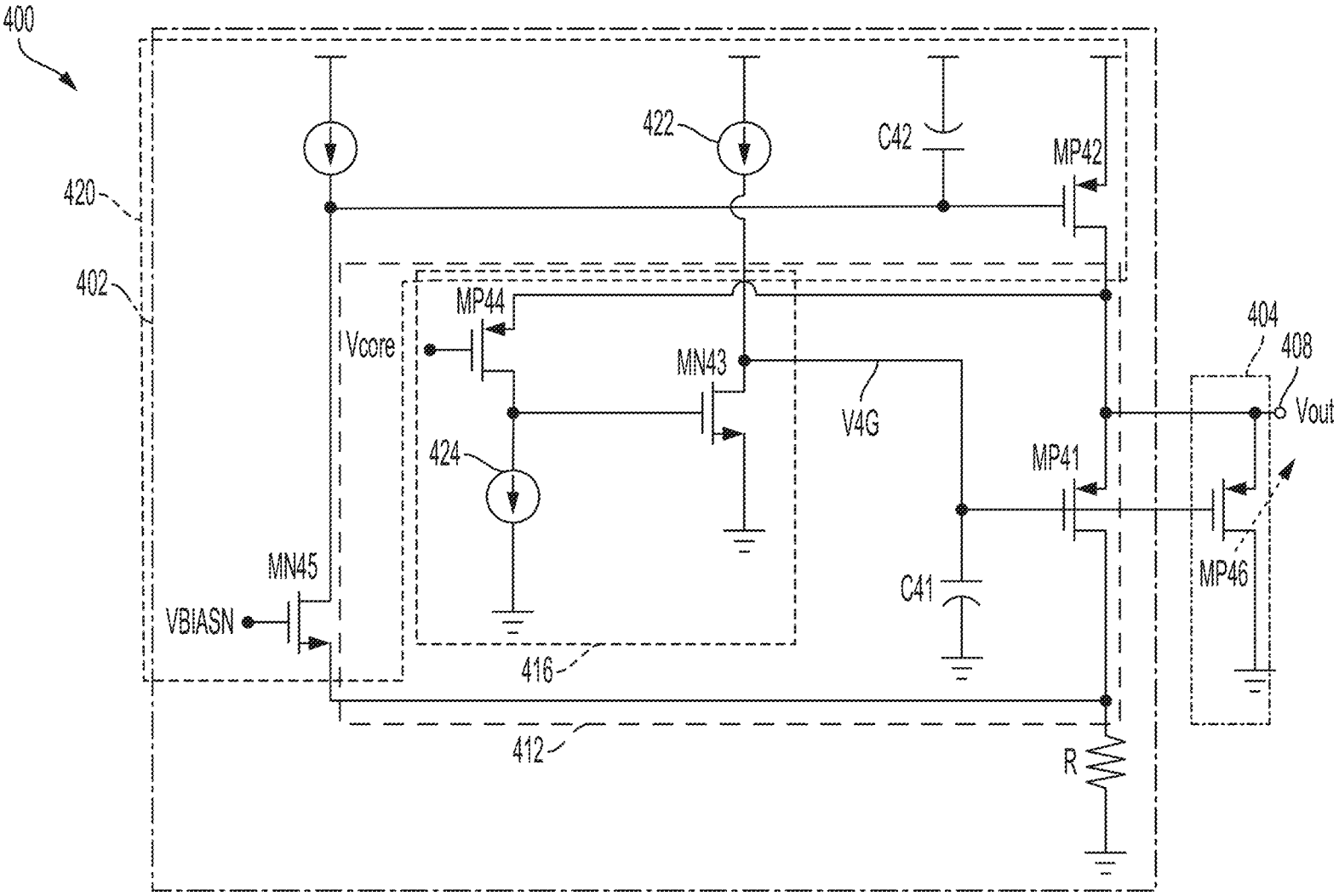
FIG. 4 is a schematic diagram of an LDO, according to some embodiments.

FIG. 4 depicts a schematic diagram of an LDO 400, according to some embodiments. The LDO 400 may include a core circuitry 402 configured to provide an output voltage $V_{OUT}$ at an output node 408, and a reverse isolation circuitry 404 coupled to the output node 408. The core circuitry 402 may include a PSRR circuitry 412 and a DC circuitry 420. The DC circuitry 420 may be configured similar to the DC circuitry 320 of FIG. 3.

The PSRR circuitry 412 may be configured to provide high PSRR. The PSRR circuitry 412 may include a p-type pass transistor MP41 and a feedback circuitry 416. The p-type pass transistor MP41 may be coupled between the output node 408 and a resistor R. The drain-to-source resistance of the p-type pass transistor MP41 may be controlled by a gate voltage $V_{4G}$ such that a stable output voltage $V_{OUT}$ is generated at the output node 408. A capacitor C41 may be coupled to the gate of the pass transistor MP41. The capacitor C41 may be configured for functionalities similar to the capacitor C1 of FIG. 3.

The feedback circuitry 416 may include a p-type transistor MP44 coupled between the output node 408 and a current source 424. The p-type transistor MP44 may receive a gate voltage $V_{CORE}$ such that the p-type transistor MP44 is turned on when a difference between the gate voltage $V_{CORE}$ and the output voltage $V_{OUT}$ is bigger than the threshold voltage of the p-type transistor MP44. The gate voltage $V_{CORE}$ of the p-type transistor MP44 may be configured to determine a DC component of the output voltage $V_{OUT}$. The feedback circuitry 416 may include a gain stage that may include an n-type transistor MN43 coupled between a current source 422 and the ground. The gate of the n-type transistor MN43 may be coupled to the drain of the p-type transistor MP44 such that the drain of the n-type transistor MN43 may generate the gate voltage $V_{4G}$ based at least in part on the difference between the gate voltage $V_{CORE}$ and the output voltage $V_{OUT}$.

The reverse isolation circuitry 404 may include a reconfigurable p-type transistor MP46 coupled between the output node 408 and the ground. The reconfigurable p-type transistor MP46 may be adjusted based at least in part on the gate voltage $V_{4G}$ to trade off between power consumed by the reverse isolation circuitry 404 and a leakage current flowing through the core circuitry 402. In some embodiments, the reconfigurable transistor p-type MP46 may include a plurality of p-type transistors connected in parallel. The number of p-type transistors being turned on may be configured based at least in part on the gate voltage $V_{4G}$ to trade off between power consumed by the reverse isolation circuitry 404 and a leakage current flowing through the core circuitry 402.

Figure 5:
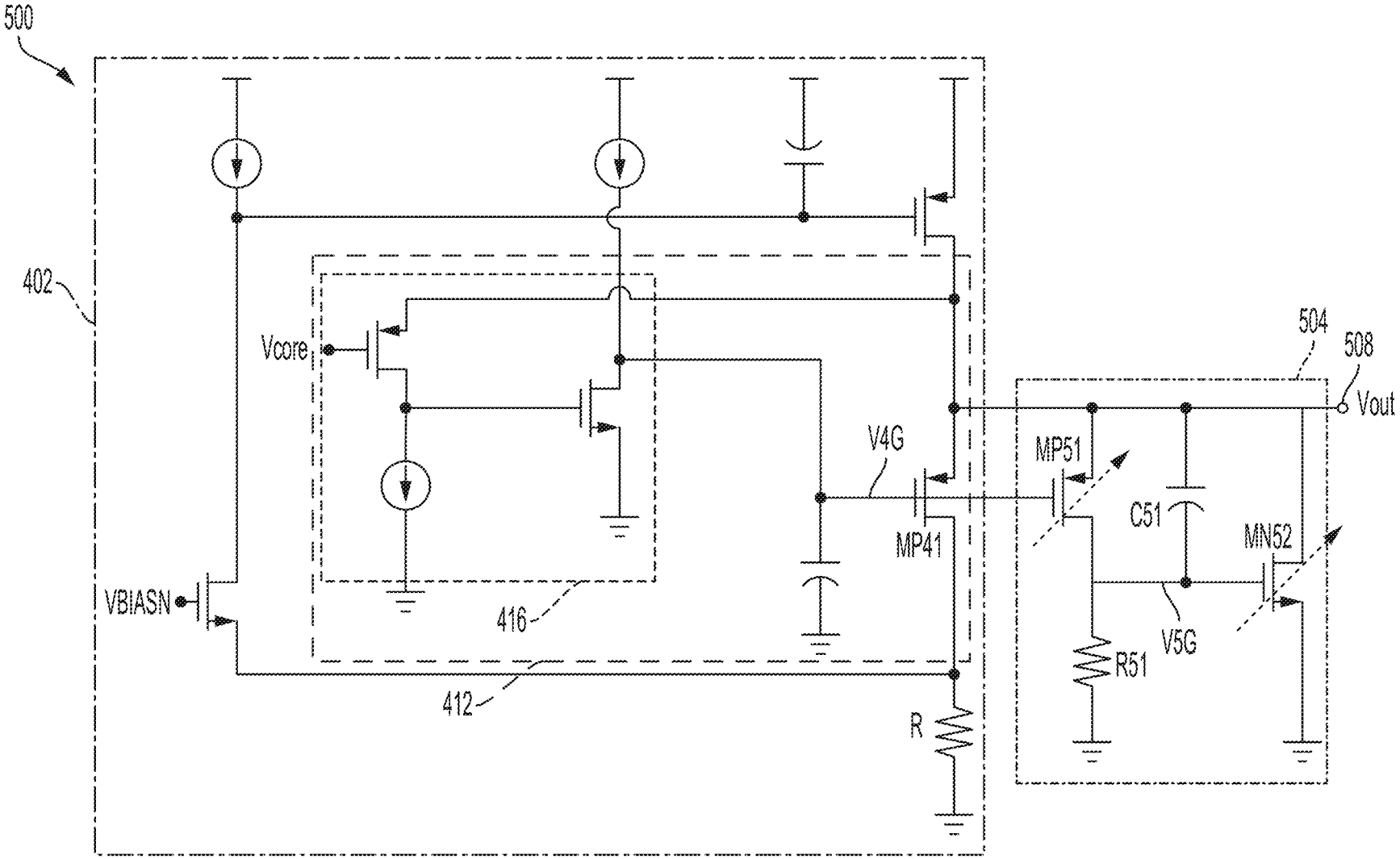
FIG. 5 is a schematic diagram of an LDO, according to some embodiments.

FIG. 5 depicts a schematic diagram of an LDO 500, according to some embodiments. The LDO 500 may include the core circuitry 402 and a reverse isolation circuitry 504. In the illustrated example, the core circuitry 402 is configured to generate an output voltage $V_{OUT}$ at an output node 508.

The reverse isolation circuitry 504 may include a reconfigurable p-type transistor MP51 coupled between the output node 508 and a resistor R51, a reconfigurable n-type transistor MN52 coupled between the output node 508 and the ground, and a capacitor C51 coupled between the output node 508 and the gate of the reconfigurable transistor MN52. The gate of the reconfigurable p-type transistor MP51 may receive the gate voltage $V_{4G}$ generated by the feedback circuitry 416 and applied to the gate of the p-type pass transistor MP41. The reconfigurable p-type transistors MP51 and the reconfigurable n-type transistor MN52 may be adjusted based at least in part on the gate voltage $V_{4G}$ to trade off between power consumed by the reverse isolation circuitry 504 and a leakage current flowing through the core circuitry 402.

Although the LDO illustrated in FIG. 5 include the core circuitry 402 and the reverse isolation circuitry 504, it should be appreciated that an LDO may include any suitable core circuitry including, for example, one of the core circuitry 302 and core circuitry 402. An LDO may also include any suitable reverse isolation circuitry including, for example, one of the reverse isolation circuitry 308, reverse isolation circuitry 408, and reverse isolation circuitry 508.

Although the illustrated examples of FIGS. 3-5 show transistors being implemented in particular types (e.g., n-type or p-type), it should be appreciated that the transistors may be implemented differently. For example, the n-type transistors in the examples may be implemented as p-type transistors while the p-type transistors in the examples may be implemented as n-type transistors.

Figure 6A:
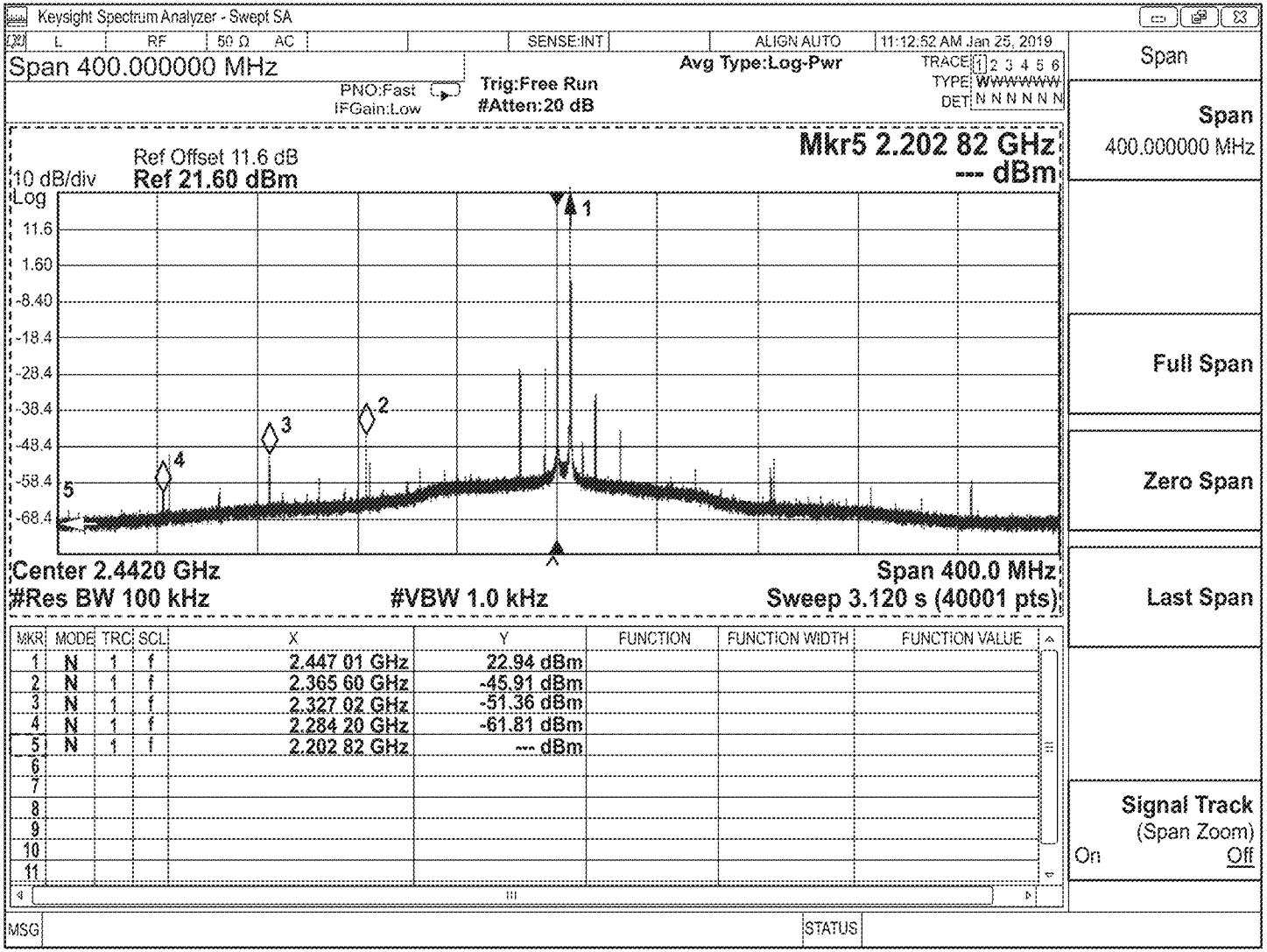
FIG. 6A is a schematic diagram illustrating an RF spur measurement result of a conventional LDO.
Figure 6B:
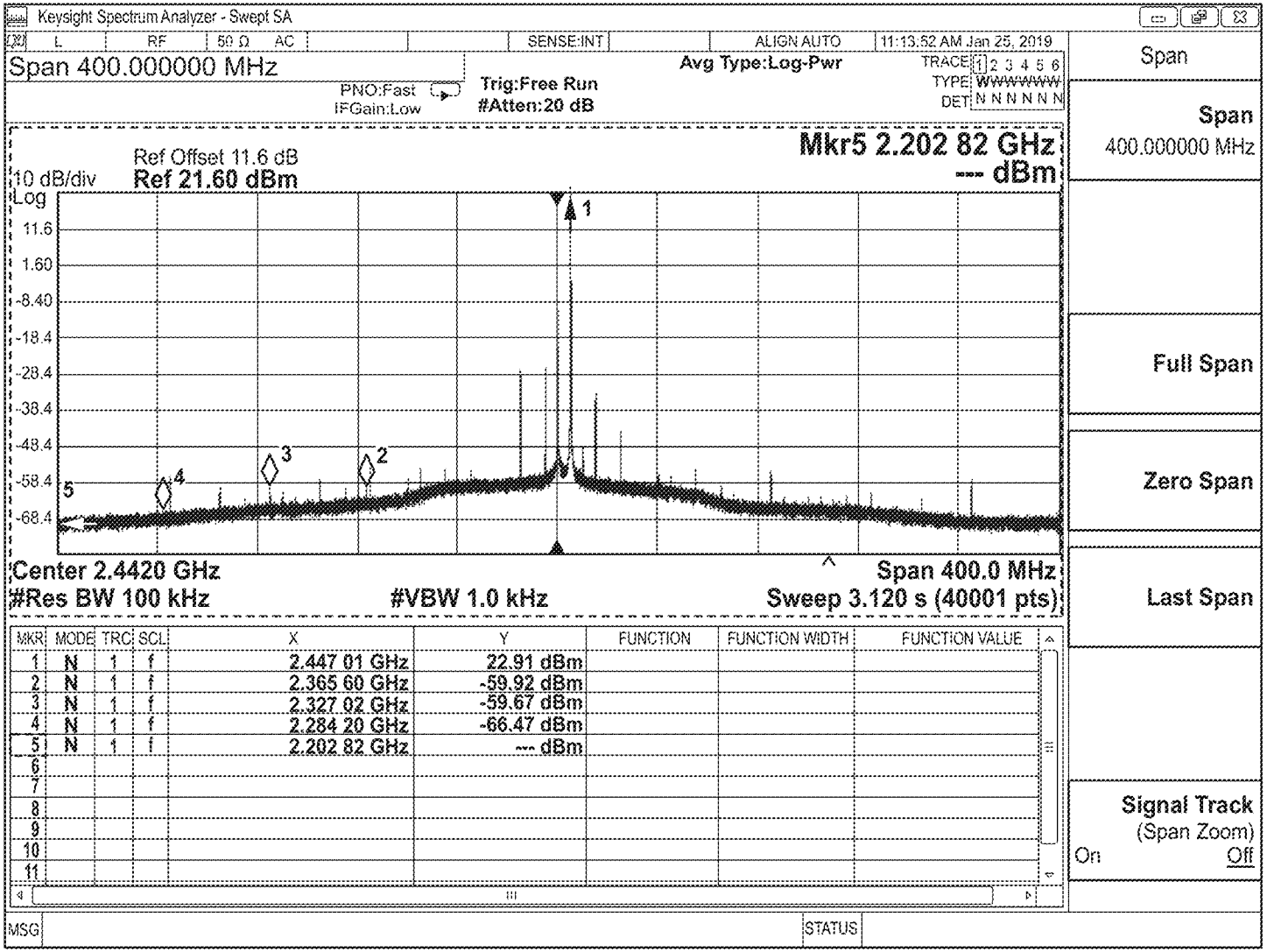
FIG. 6B is a schematic diagram of illustrating an RF spur measurement result of an LDO, according to some embodiments.

LDOs in accordance with some embodiments have better reverse isolation performance than conventional LDOs. FIG. 6A is a schematic diagram illustrating an RF spur measurement result of a conventional LDO. FIG. 6B is a schematic diagram of illustrating an RF spur measurement result of an LDO, according to some embodiments. It can be clearly seen in FIGS. 6A and 6B that, for example, the ripples (e.g., the unwanted signals labeled "2"-"5") are better suppressed by an LDO in accordance with some embodiments compared with a conventional LDO.

Figure 7A:
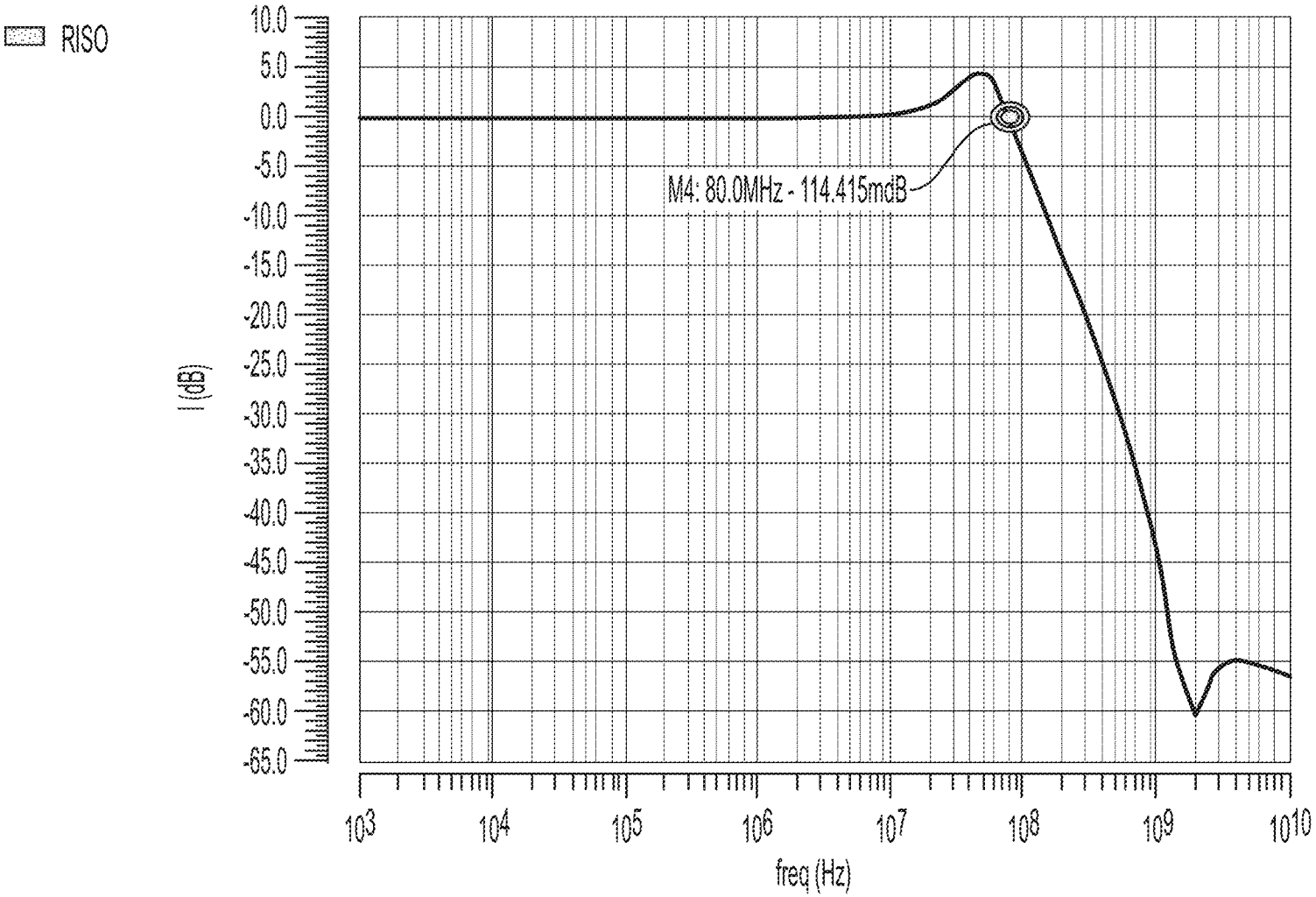
FIG. 7A is a schematic diagram illustrating reverse isolation performance of a conventional LDO.
Figure 7B:
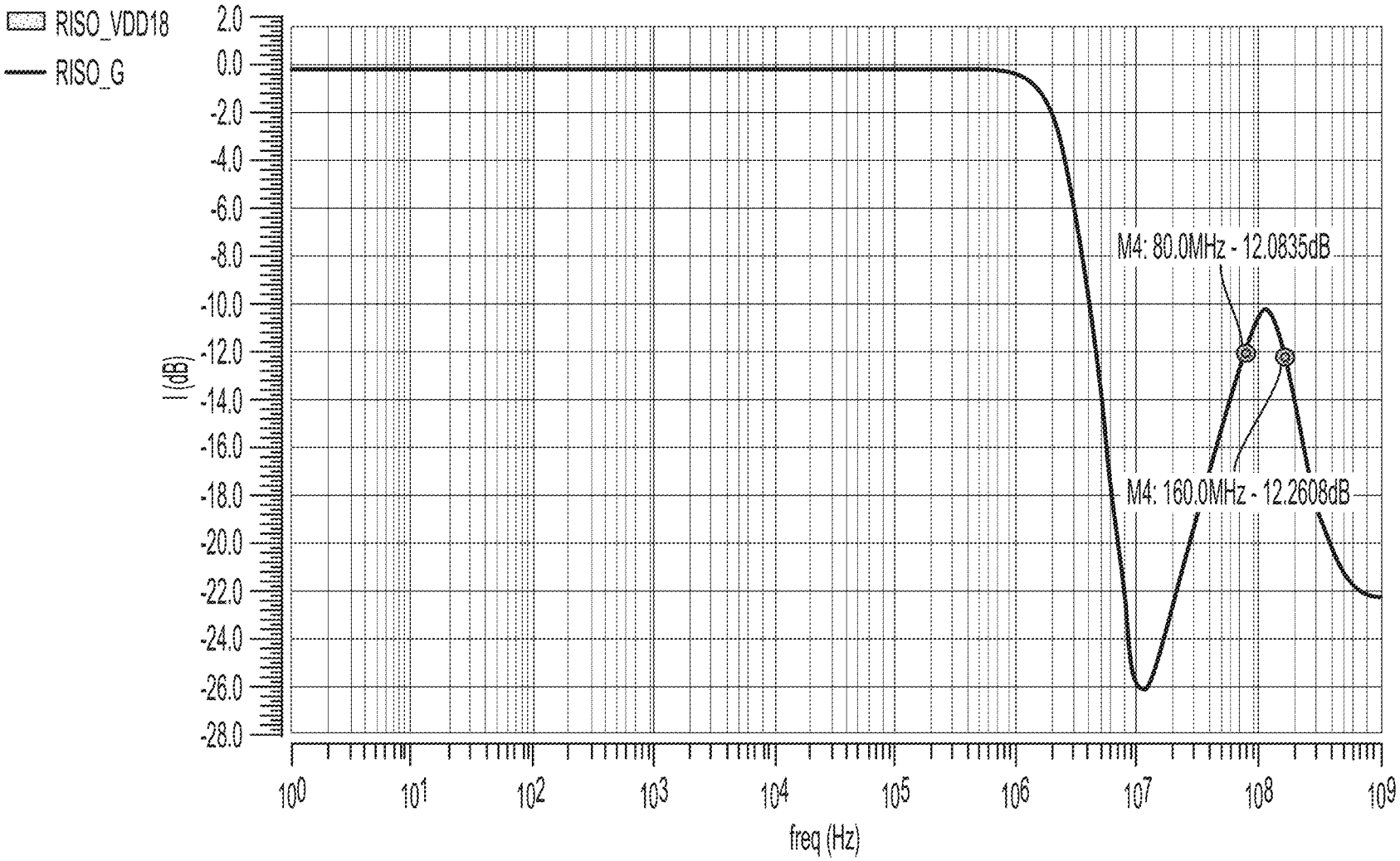
FIG. 7B is a schematic diagram illustrating reverse isolation performance of an LDO, according to some embodiments.

LDOs in accordance with some embodiments have better reverse isolation performance than conventional LDOs. FIG. 7A is a schematic diagram illustrating reverse isolation performance of a conventional LDO. FIG. 7B is a schematic diagram of illustrating reverse isolation performance of an LDO, according to some embodiments. It can be clearly seen in FIGS. 7A and 7B that, for example, at 80 MHz, an LDO in accordance with some embodiments has a reverse isolation performance of about 22 dB while a conventional LDO has a much worse reverse isolation performance of about 114 mdB.

Various aspects of the apparatus and techniques described herein may be used alone, in combination, or in a variety of arrangements not specially discussed in the embodiments described in the foregoing description and is therefore not limited in its application to the details and arrangement of components set forth in the foregoing description or illustrated in the drawings. For example, aspects described in one embodiment may be combined in any manner with aspects described in other embodiments.

The terms "approximately", "substantially," and "about" may be used to mean within ±20% of a target value in some embodiments, within ±10% of a target value in some embodiments, within ±5% of a target value in some embodiments, and yet within ±2% of a target value in some embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A low-dropout regulator comprising:

a core circuitry providing an output voltage to an output node; and a reverse isolation circuitry coupled to the output node and configured to provide a current flowing through the reverse isolation circuitry in response to ripples at the output node, wherein the core circuitry comprises a first transistor coupled to the output node, the first transistor being coupled between the output node and a ground node, wherein the reverse isolation circuitry comprises a second transistor coupled to the output node and having a second gate node controlled by a gate voltage, wherein the gate voltage additionally controls a first gate node of the first transistor.

2. The low-dropout regulator of claim 1, wherein the reverse isolation circuitry is configured with bandwidth higher than that of the core circuitry such that the reverse isolation circuitry responds to the ripples at the output node faster than the core circuitry.

3. The low-dropout regulator of claim 1, wherein the reverse isolation circuitry is configured such that a current flowing through the core circuitry is constant regardless the ripples at the output node or an alternating current (AC) component of the current flowing through the core circuitry is smaller than an AC component required to respond to the ripples at the output node.

4. The low-dropout regulator of claim 1, wherein the reverse isolation circuitry adjusts the current flowing through the reverse isolation circuitry based on a magnitude of the ripples at the output node.

5. The low-dropout regulator of claim 1, wherein the gate voltage is generated based at least in part on the output voltage at the output node.

6. The low-dropout regulator of claim 5, wherein the second transistor comprises a plurality of transistors connected in parallel.

7. The low-dropout regulator of claim 1, wherein the first transistor is a pass transistor receiving a power supply voltage to generate the output voltage at the output node.

8. The low-dropout regulator of claim 1, wherein the core circuitry comprises a direct current (DC) circuitry coupled to the output node and comprising a power transistor configured to provide the output voltage at the output node, and a power-supply rejection ratio (PSRR) circuitry coupled to the output node and configured to provide a high PSRR.

9. The low-dropout regulator of claim 7, wherein the PSRR circuitry comprises an operational amplifier configured to provide the gate voltage based at least in part on the output voltage at the output node, and a capacitor coupled to the gate voltage.

10. A low-dropout regulator comprising:

a core circuitry providing an output voltage to an output node; and a reverse isolation circuitry coupled to the output node and configured to adjust a current flowing through the reverse isolation circuitry in response to ripples at the output node, wherein the core circuitry comprises a first transistor coupled to the output node, the first transistor being coupled between the output node and a ground node, wherein the reverse isolation circuitry comprises a second transistor coupled to the output node and having a second gate node controlled by a gate voltage, wherein the gate voltage additionally controls a first gate node of the first transistor.

11. The low-dropout regulator of claim 10, wherein the current flowing through the reverse isolation circuitry is adjusted at least in part to trade off between power consumed by the reverse isolation circuitry and a leakage current flowing through the core circuitry.

12. The low-dropout regulator of claim 10, wherein the reverse isolation circuitry comprises a plurality of transistors connected in parallel, and one or more of the plurality of transistors are turned on depending on a tradeoff between power consumed by the reverse isolation circuitry and a leakage current flowing through the core circuitry.

13. The low-dropout regulator of claim 10, wherein the gate voltage is generated based at least in part on the output voltage at the output node.

14. The low-dropout regulator of claim 10, wherein the first transistor is a pass transistor receiving a power supply voltage to generate the output voltage at the output node.

15. The low-dropout regulator of claim 10, wherein the core circuitry comprises a direct current (DC) circuitry coupled to the output node and comprising a power transistor configured to provide the output voltage at the output node, and a power-supply rejection ratio (PSRR) circuitry coupled to the output node and configured to provide a high PSRR.

16. The low-dropout regulator of claim 15, wherein the PSRR circuitry comprises an operational amplifier configured to provide the gate voltage based at least in part on the output voltage at the output node, and a capacitor coupled to the gate voltage.

17. The low-dropout regulator of claim 16, wherein the core circuitry comprises a decrease gain circuitry coupled to the output node and configured to reduce a gain of the DC circuitry.

18. A low-dropout regulator comprising:

a core circuitry configured to provide an output voltage to an output node; and a reverse isolation circuitry coupled to the output node and configured to provide a current flowing through the reverse isolation circuitry, wherein the current flowing through the reverse isolation circuitry is configurable and/or reconfigurable, wherein the core circuitry comprises a first transistor coupled to the output node, the first transistor being coupled between the output node and a ground node, wherein the reverse isolation circuitry comprises a second transistor coupled to the output node and having a second gate node controlled by a gate voltage, wherein the gate voltage additionally controls a first gate node of the first transistor.

* * * * *